US010140789B2

(12) United States Patent
Corrie et al.

(10) Patent No.: US 10,140,789 B2
(45) Date of Patent: Nov. 27, 2018

(54) METHOD AND APPARATUS FOR MONITORING OPERATION OF A VEHICLE

(71) Applicant: Trak (Global Solutions) Limited, Cheshire (GB)

(72) Inventors: Nicholas Charles Corrie, Cheshire (GB); Peter Finch, Altrincham (GB); Kamran Mahmoudzadeh, Edingdale (GB); Alan William Clement Contrill, Warwickshire (GB)

(73) Assignee: Trak (Global Solutions) Limited, Crewe (GB)

( * ) Notice: Subject to any disclaimer, the term of this patent is extended or adjusted under 35 U.S.C. 154(b) by 45 days.

(21) Appl. No.: 15/288,857

(22) Filed: Oct. 7, 2016

(65) Prior Publication Data

US 2018/0101999 A1 Apr. 12, 2018

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01)

(58) Field of Classification Search
CPC ..... G07C 5/085; G07C 5/008
See application file for complete search history.

(56) References Cited

U.S. PATENT DOCUMENTS 5,825,283 A 10/1998 Camhi
6,553,308 B1 4/2003 Uhlmann et al.
6,556,905 B1 4/2003 Mittelsteadt et al.
6,564,127 B1 5/2003 Bauerle et al.
6,862,525 B1 3/2005 Beason et al.
6,931,309 B2 8/2005 Phanlan et al.
7,082,359 B2 7/2006 Breed
7,113,127 B1 9/2006 Banet et al.
7,117,075 B1 10/2006 Larschan et al.
7,343,306 B1 3/2008 Bates et al.
2002/0095249 A1 7/2002 Lang
(Continued)

FOREIGN PATENT DOCUMENTS

EP 1063494 A1 12/2000
WO WO 2007/044881 A2 4/2007

OTHER PUBLICATIONS

Thomas, Dallas. "How to Connect to a Bluetooth Device". Gadget Hacks <https://android.gadgethacks.com/how-to/android-basics-connect-bluetooth-device-0163780/>. Published Aug. 18, 2015.*

*Primary Examiner* — Mussa A Shaawat
*Assistant Examiner* — Michael V Kerrigan
(74) *Attorney, Agent, or Firm* — Leydig, Voit & Mayer, Ltd.; Gerald T. Gray

(57) ABSTRACT

A method and apparatus for monitoring operation of a vehicle 1 by a driver, in order to monitor driver behavior using a personal mobile electronic device 2. The electronic device detects wireless signals and determines if the identity of a device 3 transmitting the signal is known in order to identify if the driver is driving a vehicle to be monitored. Monitoring is then carried out only by the electronic device. Monitoring only takes place when a signal from a known transmitting device is detected avoiding unnecessarily recoding journeys and preserving battery life of the electronic device. A set-up mode is provided to enable a user to identify vehicles for monitoring.

28 Claims, 3 Drawing Sheets

(56) References Cited

U.S. PATENT DOCUMENTS

| | | | | |
|---|---|---|---|---|
| 2003/0233190 | A1 | 12/2003 | Jones | |
| 2004/0113842 | A1 | 6/2004 | du Toit et al. | |
| 2004/0153362 | A1 | 8/2004 | Bauer et al. | |
| 2004/0209601 | A1 | 10/2004 | Obradovich et al. | |
| 2007/0032225 | A1 | 2/2007 | Konicek et al. | |
| 2007/0128119 | A1 | 6/2007 | Babich | |
| 2008/0134888 | A1 | 6/2008 | Chao et al. | |
| 2008/0294302 | A1 | 11/2008 | Basir | |
| 2014/0100767 | A1* | 4/2014 | Miljkovic ..... | G01C 21/3697 701/123 |
| 2014/0207309 | A1* | 7/2014 | Armitage ..... | G07C 5/008 701/1 |

* cited by examiner

METHOD AND APPARATUS FOR MONITORING OPERATION OF A VEHICLE

TECHNICAL FIELD

Embodiments of the present invention relate to a method and apparatus for monitoring operation of a vehicle and particularly, but not exclusively, a method and apparatus for monitoring operation of a road vehicle by a driver authorised to drive that vehicle.

BACKGROUND

It is known to monitor operation of road vehicles to provide data for assessing the insurance risk presented by a driver of the vehicle. This can be achieved by fitting dedicated monitoring equipment to a vehicle, often referred to as a "black box". This equipment typically comprises a positioning system (such as GPS) to determine the speed and location of the vehicle, an accelerometer or other motion sensor(s), a memory for recording vehicle operating data and/or a transmitter arranged to transmit vehicle operating data via a wireless (e.g. cellular) network to a server where it can be used by an insurer of the vehicle. Providing and installing this equipment is relatively costly.

As an alternative, it has been recognised that many smartphones comprise at least some of the hardware useful for monitoring operation of a vehicle and transmitting operating data for use by an insurer. Thus, a driver's smartphone can be employed either alone or together with equipment installed in a vehicle to monitor operation of a vehicle and thus reduce or eliminate the cost of equipping a vehicle with monitoring equipment. A further advantage of this approach is that a smartphone serves to identify the driver.

However, existing such systems present a number of problems.

Where a smartphone is used on its own to monitor vehicle operation it is necessary for the driver to initiate monitoring at the beginning of a journey and cease monitoring at the end of the journey. The driver may simply forget to do this. Alternatively the smartphone can be configured to detect that a journey has commenced, by monitoring movement of the smartphone and recognising characteristics of a journey in a road vehicle. In this case, though, the smartphone will recognize journeys where the owner is not the driver, such as when the driver is a passenger in a motor car or taking public transport and thus record data for those journeys which is not relevant for assessing the driver's insurance risk. To overcome this it is necessary for the driver to provide some manual input to verify whether or not they are driving the insured vehicle for each monitored journey. This can be time consuming and irritating to the driver and, if overlooked, can lead to incorrect data being recorded. Also, the need for the smartphone to continually monitor movement and detect when its user is making a road journey results in a significant processing and power consumption overhead, leading to a reduced battery life. This may encourage a user to disable the monitoring function to save power, resulting in incomplete collection of data.

The present embodiments have been made in consideration of these problems.

It is an object of embodiments of the invention to provide apparatus and methods for monitoring vehicle operation using a personal mobile electronic device which minimize, cost, power consumption and the need for user intervention. These apparatus and methods may be used for monitoring driver behaviour to help assess insurance risk or for other purposes such as management of fleets of vehicles, particularly with a view to assessing driver safety.

SUMMARY

According to an aspect of the invention there is provided a method for monitoring operation of a vehicle by a driver, in order to monitor driver behaviour, using a personal mobile electronic device ("electronic device"), the method comprising:

a. placing the electronic device in the vehicle;

b. detecting one or more wireless signals with the electronic device;

c. reading an identity of a respective transmitting device for the, or each, wireless signal detected;

d. determining if any read identity is stored in a memory of the electronic device or stored on a remote server in association with information identifying the electronic device or driver by accessing the server via a communications network; and e. if or when a read identity is determined to be stored in the memory of the electronic device and/or the remote server, enabling operation of a positioning device and/or motion sensor of the electronic device thereby to detect movement of the electronic device.

According to an aspect of the invention there is provided a method for monitoring operation of a vehicle by a driver, in order to monitor driver behaviour, the method comprising:

a. detecting one or more wireless signals with a personal mobile electronic device ("electronic device") located in the vehicle;

b. reading an identity of a respective transmitting device for a, or each, wireless signal detected;

c. determining if any read identity is stored in a memory of the electronic device or stored on a remote server in association with information identifying the electronic device or driver by accessing the remote server via a communications network; and d. if or when a read identity is determined to be stored in the memory of the electronic device and/or the remote server, enabling operation of a positioning device and/or motion sensor of the electronic device thereby to detect movement of the electronic device.

According to another aspect of the invention there is provided a personal mobile electronic device adapted for monitoring operation of a vehicle by a driver, in order to monitor driver behaviour, the device comprising:

a. an electronic signal detector arranged to detect wireless signals and read an identity of a transmitting device transmitting the signal;

b. a memory;

c. a wireless communication system for communicating with a remote server via a communications network;

d. a positioning device and/or motion sensor; and e. a processor arranged to determine if an identity of a transmitting device read by the electronic signal detector is stored in the memory of the electronic device and/or stored on the remote server in association with information identifying the electronic device or driver by accessing the server via the communications network; wherein f. the processor is arranged to enable operation of the positioning device and/or motion sensor if the identity of a transmitting device read by the electronic signal detector is stored in the memory of the electronic device and/or stored on the remote server in association with information identifying the electronic device or driver, thereby to detect movement of the electronic device.

Both aspects enable a personal mobile personal electronic device to be used to recognise the vehicle by recognising a known transmitter of a wireless signal associated with the vehicle. Any identifiable transmitter may be used, including a transmitter provided on the vehicle for a purpose other than monitoring vehicle movement or operation and/or driver behaviour. The transmitting device may, for example, form part of an in-vehicle entertainment or communication system. It may form part of original or after-market equipment fitted to the vehicle.

The transmitting device may transmit any suitable form of wireless signal which can convey an identity of the device. This could be a radio frequency electromagnetic signal, for example a WLAN or Bluetooth® signal. It could be an optical, e.g. infra-red, or audio signal. The electronic device should therefore be provided with an appropriate detector or detectors to enable it to detect wireless, such as an antenna, photo detector or microphone.

Following identification of the vehicle, by detecting a wireless signal from a recognised transmitting device, monitoring of the vehicle may be subsequently carried out only by the mobile electronic device, without any information relating to operation of the vehicle being provided to the electronic device by the transmitting device.

The personal mobile electronic device may be a smartphone, personal digital assistant or any other suitable mobile electronic device having the necessary functionality to perform method. The electronic device may be a computing device. The positioning device may be any suitable device which enables the position (or an approximate position) of the electronic device to be determined. It could, for example, be a device which utilises a global navigation satellite system (GNSS), and comprise an appropriate chip set. Alternatively it could be a wireless receiver cable of determining position by triangulation from telecoms transmission towers. The motion sensor may be an accelerometer, gyroscope, tremble switch or any other suitable motion sensor.

The method may comprise the further step of storing data relating to movement of the electronic device in the memory of the electronic device and/or transmitting the data to a remote server, thereby to record details of a journey made by the vehicle when operation of the positioning device has been enabled and the positioning device has determined a position of the electronic device.

Alternatively or additionally, following enabling operation of the positioning device and/or motion sensor, the method may further comprise, and the apparatus may be arranged to perform, the steps of:

a. determining, using the positioning device and/or motion sensor, if the electronic device is moving; and b. if the electronic device is moving, storing data relating to movement of the device in the memory of the electronic device and/or transmitting the data to a remote server, thereby to record details of a journey made by the vehicle.

With this approach, storing data may only commence if movement at or above a threshold speed is detected. This helps avoid recording non-vehicle related movement of the electronic device and thus generating spurious data and needlessly draining an electric battery of the mobile electronic device.

When the wireless signal of the transmitting device with an identity stored in the memory of the electronic device and/or server is no longer detected by the electronic device recording details of the journey may be stopped. Lack of a wireless signal indicates that the electronic device, and by implication the driver, is no longer near the vehicle being monitored and therefore that the journey has ended.

Or, recording details of the journey may be stopped only when the wireless signal of the transmitting device with an identity stored in the memory of the electronic device and/or server is no longer detected by the electronic device and no further movement of the electronic device is detected. This avoids stopping recording a journey owing to a temporary loss of the wireless signal when the vehicle, and thus the electronic device, are in motion whilst avoiding stopping recording the journey when the vehicle temporarily stops during the journey.

The mobile personal electronic device may comprise an operating system and the step of detecting wireless signals may be performed by the operating system, in order that signal detection is continuous when the device is turned on whilst minimising the power consumption of the device.

A software application for monitoring operation of a vehicle may be provided on the electronic device, such as by being stored in its memory, and the device may be arranged to start the application (if it is not already running) on detection of a wireless signal. This function may be provided by the operating system. The operating system may comprise an event handler. The event handler may be configured, for example during installation of the software application on the device, to start the software application when a wireless signal is detected. Detection of a signal may be taken to be when the identity of the transmitting device producing the signal has been read by the electronic device. Detection of a signal may also be taken to be when a pairing event takes place with a transmitting device.

Following starting, the software application may be arranged to cause the electronic device to determine if the identity of the transmitting device producing the detected signal is stored in the memory of the electronic device and/or on a remote server. The software application may be further arranged such that, if the identity of the transmitting device is not stored in the memory of the electronic device and/or on the remote server, the application then closes or is placed into a dormant or background state in which the processing required to run the application is reduced. This minimizes or reduces power consumption of the device.

To set up the electronic device for use it is necessary to store the identity of a transmitting device, or devices, associated with a vehicle or vehicles it is desired to monitor when driven by the driver on the mobile personal electronic device and/or on the remote server. This may be achieved by a user of the electronic device, and may involve the following steps:

a. placing the electronic device in or near the vehicle to be monitored;

b. enabling a set-up mode on the electronic device;

c. searching for wireless signals using the electronic device;

d. displaying, on a display of the electronic device, the identity of a transmitting device transmitting the/or each detected signal; and e. selecting a transmitting device known to be on, or otherwise associated with, the vehicle.

The identity of the selected transmitting device may then be stored in the memory of the electronic device and/or transmitted to a remote server together with information identifying the electronic device and/or driver.

Where a vehicle is not already provided with a transmitting device that can be used to allow a driver's electronic device to identify the vehicle a self-contained wireless transmitting device which transmits a wireless signal conveying an identity of the device can be placed on the vehicle to serve this function. This could be a low cost, self-contained, battery operated wireless transmitter. In one embodiment it is a Bluetooth Low Energy® transmitter. Other embodiments are possible, though, which transmit different types of wireless signals, e.g. classic Bluetooth®, WLAN, audio or optical signals. Such a transmitter transmits an electronic signal which carries only an identity of the transmitter.

BRIEF DESCRIPTION OF THE DRAWINGS

In order that the invention may be more clearly understood an embodiment thereof will now be described, by way of example only, with reference to the accompanying drawings, of which.

DETAILED DESCRIPTION OF EMBODIMENTS OF THE INVENTION

Figure 1:
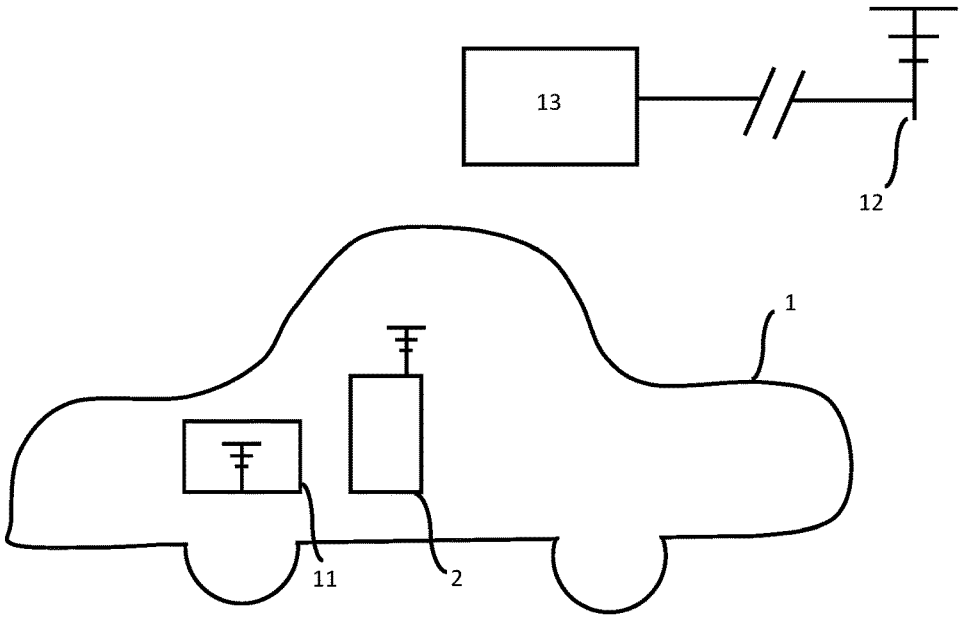
FIG. 1 is a schematic diagram of an automobile, driver's smartphone and remote server.
Figure 2:
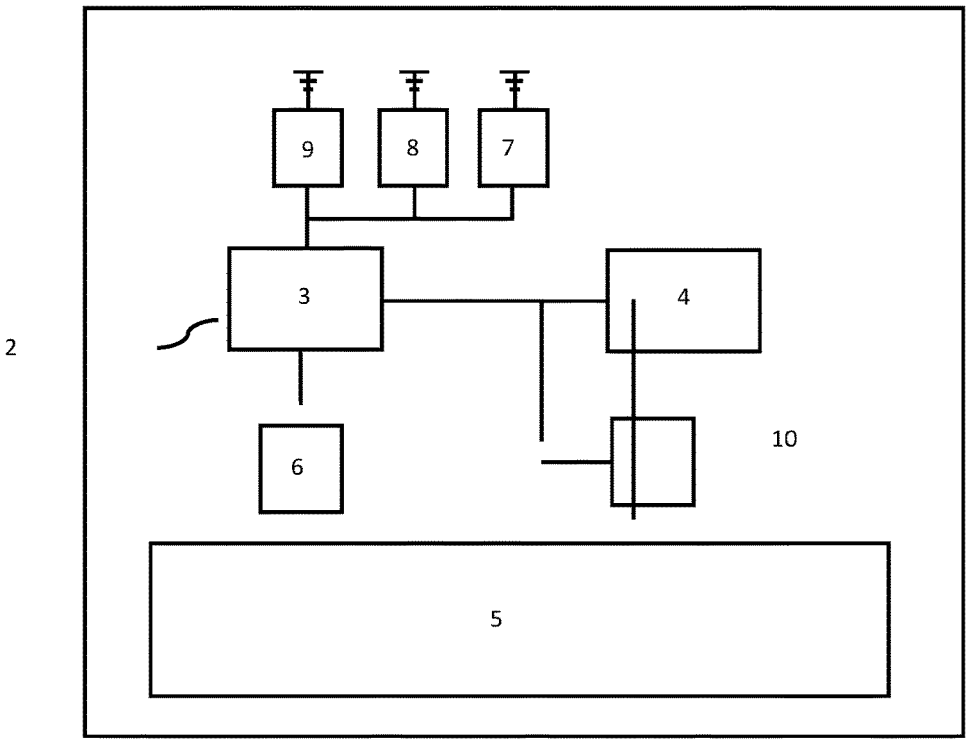
FIG. 2 is a schematic diagram of the driver's smartphone of FIG. 1.
Figure 3:
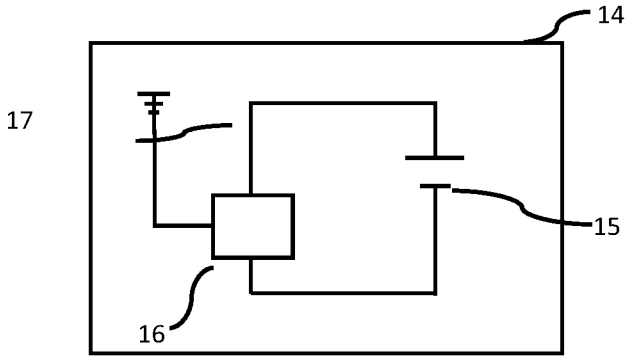
FIG. 3 is a schematic diagram of a Bluetooth Low Energy® transmitter.

Referring to the drawings, in an example where a vehicle is monitored to assist in calculating insurance risk, when a driver takes out an automobile insurance policy covering him/her to drive one or more automobiles 1, or other road vehicles, the insurance company provides the driver (or causes the driver to be provided with) with a monitoring software application to run on his/her personal electronic device, typically a smartphone 2. Where a vehicle is monitored for other purposes the monitoring software may be provided to drivers by a fleet manager, employer, organisation providing a vehicle monitoring service or another interested party. It will be apparent that whilst described in relation to monitoring of an automobile, the invention is equally applicable to monitoring of other vehicles such as vans, trucks, commercial vehicles and other on and off-road vehicles.

To be satisfactory, the electronic device must comprise at least one computer processing unit (CPU) 3, memory 4, user interface 5 (typically a touch screen) enabling information to be conveyed to, and an input received from, a user, positioning system 6 (e.g. a GNSS chipset) and at least one means of wireless communication 7. As with most current smartphones it should ideally comprise a cellular communications circuit 7 allowing it to send and receive data over a public telephone or data network and connect to the Internet, a wireless communications circuit 8 for communication with a wireless local area network (WLAN—also known as WiFi) and a wireless communication circuit 9 for communication using the Bluetooth® protocol. The device may of course include circuits or other apparatus enabling communication via other wireless systems. The device may also include a motion sensor 10, such as an accelerometer, gyroscope, tremble switch or some other motion sensor.

For convenience the device will be described as a smartphone in what follows but it will be appreciated that any personal electronic device with comparable functionality could be employed.

The smartphone runs an operating system, for example Apple® iOS®, Google® Android® or Windows® Phone OS, enabling it to run software applications.

The driver typically downloads the monitoring software provided by the insurance company, fleet manager, operating company or other party from a remote server, and installs it onto their smartphone.

Following installation the driver must set up the monitoring application for use.

Firstly the driver must enter details of their insurance policy (such as a policy number) and/or personal data into their smartphone as prompted by the application in order to identify themselves to the insurance company, fleet operator or other organisation with an interest in monitoring the driver's driving.

Figure 4:
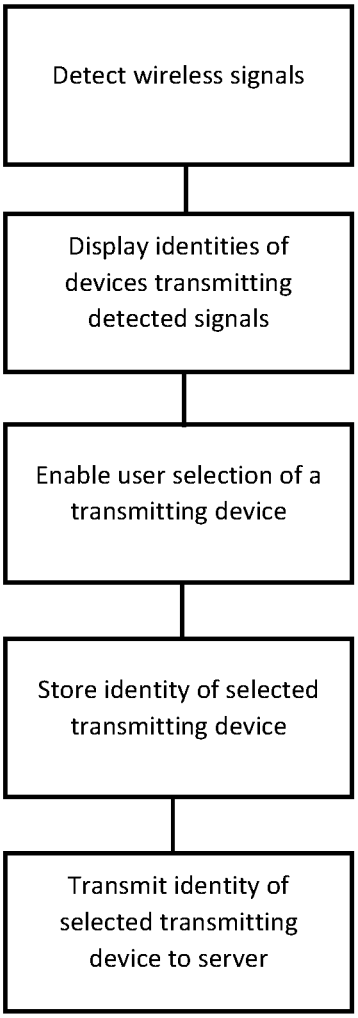
FIG. 4 is a flow chart illustrating a set-up process.

Secondly, and as shown in FIG. 4, the driver must place the monitoring application software into a set-up mode, by selecting the mode using menus displayed on the phone's display and place the phone into or near the insured automobile, or fleet vehicle the driver is authorised to drive, with the vehicle and/or any relevant ancillary equipment fitted to the vehicle powered on. In this mode the application causes the phone to scan for wireless signals and to display these to the user. The phone will thus detect any signals produced by the automobile's systems or ancillary equipment (such as for example a hands free telephone system) installed in the automobile. Typically, the driver's automobile will include a wireless transmitter/receiver 11 intended for communicating with a smartphone to enable the phone to transmit information to and/or receive information from the automobile's entertainment system and/or an in vehicle interface enabling the driver to operate the smartphone using controls in the vehicle, for example to cause the phone to play audio over the vehicle's entertainment system and/or make hands free telephone calls.

Any detected signals will be displayed on the smartphone's display and the driver prompted to select a signal which is known to be associated with the automobile. The application will then cause the smartphone to save data identifying the transmitting device 8 producing the selected signal, the data being carried by the signal. This data is then saved in the memory of the smartphone, it is also transmitted by the smartphone via a communications network 12 to a server 13, accessible by the insurance company fleet manager or other interested party, where it is stored in association with information identifying the driver and/or the driver's smartphone 2 and/or the vehicle.

Significantly, the transmitting device 11 on the automobile can be for any purpose and does not have to be configured to assist monitoring operation of the automobile in any way. In particular the transmitting device does not need to be capable of transmitting any information relating to operation of the automobile, including any information relating to movement of the automobile. Nor does it need to be able to transmit any identifying information derived from the automobile. It merely serves to identify the automobile by virtue of its association with the automobile and so effectively the only requirement is that the transmitting device transmits an identity (effectively its own identity) which can be read by the smartphone. As mentioned above, most automobiles will be provided with at least one transmitting device 11 which can serve this purpose. Where this is not the case, the driver may be provided with an appropriate transmitting device 14 to place in the vehicle. A self-contained Bluetooth Low Energy® transmitter may be provided for this purpose, comprising an electric battery 15, a Bluetooth Low Energy® transmitting circuit 16 and an antenna 17, which the driver places on the automobile, typically adhering it to the automobile's windshield or instrument panel. The transmitter is ideally placed in the vehicle, near to the driver to improve the chances of the signal it transmits being detected by the driver's smartphone, which is normally expected to be on the driver's person. Or, the transmitting device might be placed in or near a receptacle or holder for a driver's smart phone. As an alternative to using a dedicated transmitting device to enable the driver's smartphone an item of aftermarket equipment, such as a hands free telephone kit, comprising a suitable transmitter could be installed in the vehicle. The signal produced by the transmitter can then be selected during the set-up procedure, and conveys an identity of the transmitter.

Figure 5:
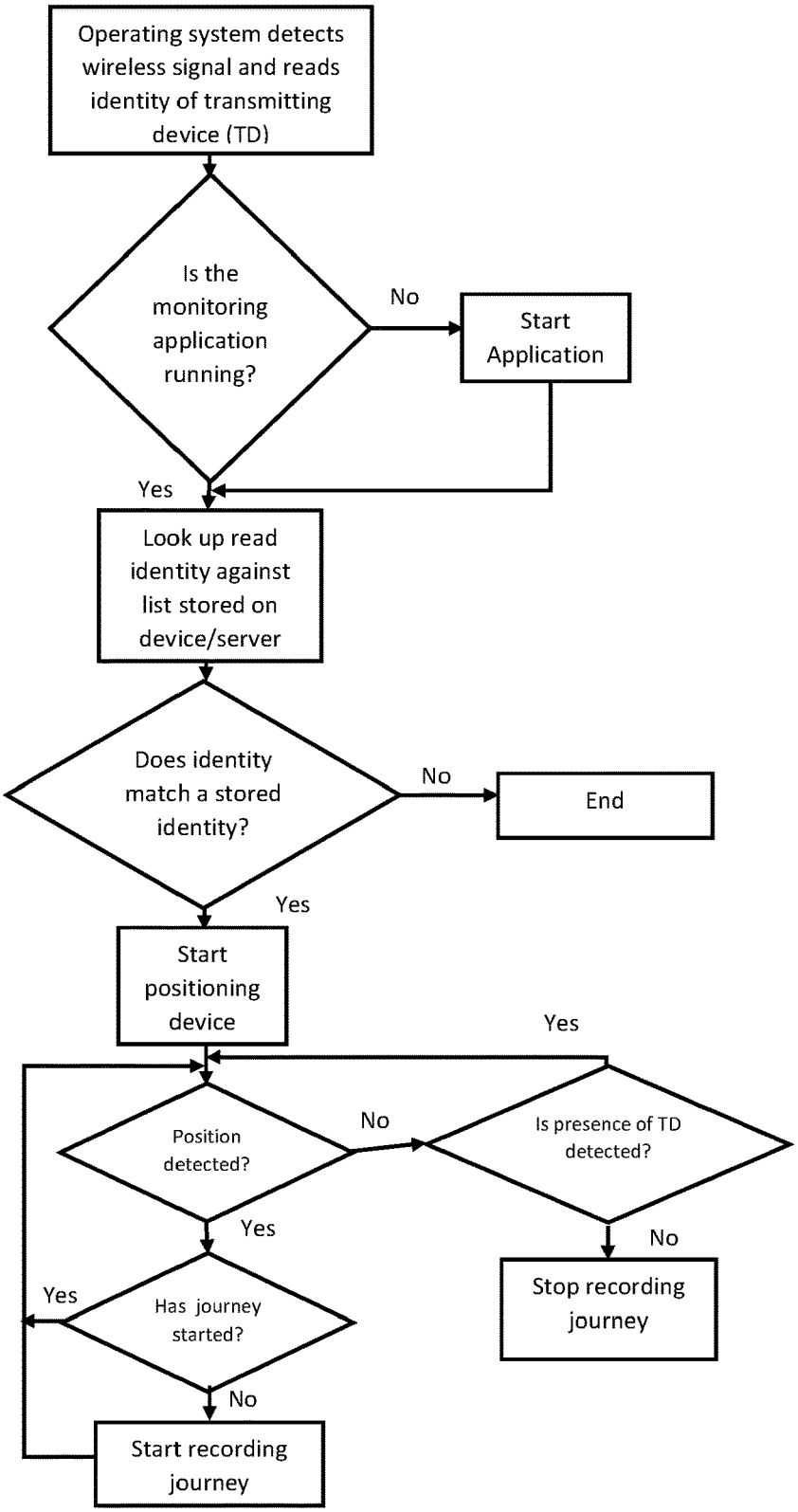
FIG. 5 is a flow chart showing operation of the smartphone to monitor the driver's operation of the automobile.

The monitoring system is now ready for use. Its operation will now be described, and is also illustrated in FIG. 5.

Installation of the monitoring application on the driver's smartphone 2 causes an event handler comprised in its operating system to run the monitoring software application when the operating system detects a signal produced by a transmitting device, such as a Bluetooth® signal, unless the application is already running. In the example of a Bluetooth® signal, the event handler may cause the monitoring software to run when a Bluetooth® pairing event takes place. It is an existing function of smartphone operating systems to automatically detect and identify transmitting devices, provided that the user has not disabled the relevant communication functions of the smartphone.

The monitor software causes the smartphone to provide the remaining functionality of the monitoring system.

When the monitoring software runs, it causes the smartphone to compare the identity of the transmitting device producing the detected signal with that stored during the set up process. This comparison may take place either on the smartphone 2 or at the server 13.

If the identity is not stored on the smartphone 2 or server 13 the software application stops any further check and remains idle or closes.

If the identify is stored on the smartphone 2 or server 13 this is indicative that the smartphone is nearby, and most probably in, a vehicle insured by the driver or vehicle the driver is authorised to drive. In this case the software causes the smartphone's positioning system 6 to operate and determine the position, and thus also movement, of the phone. Where the smartphone is provided with an accelerometer and/or other additional motion sensor 10 this may also be activated.

When the positioning system determines the position of the electronic device the software is configured to start recording a journey, by recording time and position of the phone and/or other data derived from the positioning system, and accelerometer, if present.

In an alternative embodiment recording of a journey only commences when the positioning system has determined the position of the electronic device and that the device is moving. In yet another embodiment, recording of a journey only commences when the positioning system has determined the position of the electronic device and that the device is moving at greater than a threshold speed. Requiring a threshold minimum speed helps to filter out movement which is not due to the automobile, for example by a driver walking past an insured/authorised vehicle. The threshold speed may be 4 mph, with recording only commencing where movement at or above this threshold is measured.

The recorded data is stored in the memory of the smartphone and transmitted via the public communications network 12 to the server 13 where it is stored. When data has been successfully received by the server it sends an acknowledgement to the smartphone which then deletes some or all of the transmitted data or records that the data may be deleted.

The smartphone may, for example, retain only a subset of journey data when an acknowledgement of receipt has been received from the server. This enables a useful summary of journeys to be retained in the memory of the smartphone whilst minimising the amount of storage space required. The subset of data might, for example, be positions (that may be represented by latitude and longitude coordinates) along a route the smartphone has travelled for each recorded journey. It could also include the start and stop times (including date) of each journey, and/or times at waypoints along the journey. It may lack information relating to the time at every recorded point along the journey and/or speed and/or direction of travel and/or acceleration and/or data indicative of driver behaviour throughout the journey.

Monitoring of the journey continues until no movement is detected and the signal from the registered transmitting device is no longer detected, at which point the software application remains idle, is rendered dormant or closes. Data relating to the journey is then available to the insurance company or other interested party and enables them to assess driver behaviour and calculate insurance risk. And/or the insurance company or interested party may use the information to provide feedback to the driver. This may take the form of a reward, in the form of a discount, payment, offer or voucher, when low risk (or lower than an average risk for the driver concerned) driving behaviour is recorded. It could also take the form of a penalty, such as an increased insurance premium or accumulation of points that could lead to an increased insurance premium, when higher risk (or higher than average risk for the driver concerned) driving behaviour is detected.

Where a driver takes out an insurance policy covering him/her to drive multiple vehicles, or is authorised to drive multiple vehicles in a fleet of vehicles, his/her smartphone should be set up in each vehicle to identify and store the identity of a (different) transmitting device associated with each vehicle. In this case the monitoring software application may prompt the user to enter an identity (such as a license plate number or vehicle identification number) for each vehicle and this is stored on the smartphone and/or on the server in association with the identity of the transmitting device. Such an identity may also be required where an insurance policy only covers a driver for one vehicle, or a driver is only authorised to drive a single vehicle in a fleet. This enables an insurance company, fleet manger or other interested party to attribute journey data to a particular vehicle. This identification data may also be stored on the server, and may be transmitted to the server together with journey data.

An insurance policy may cover more than one driver to drive the same vehicle or vehicles. Likewise, several drivers may be authorised to drive one or multiple vehicles in a fleet. In this case each driver must set up their own smartphone in the/or each vehicle.

The apparatus and methods outlined confer several advantages over known systems utilising smartphones to monitor vehicle operating data.

In most cases it is not necessary for any additional equipment to be installed in a vehicle to be monitored as any transmitting device inherent to the vehicle can be used. Where an appropriate transmitting device is not present, all that need be installed is a passive transmitter for example a low-cost, low-energy Bluetooth® transmitter. This reduces the cost of implementation.

Once the software has been installed and set up on a driver's smartphone then, provided that the driver carries their phone, its operation is automatic. Driver intervention is not required to start and stop recording of journeys. This overcomes the problem with the prior art of a driver accidentally or deliberately not monitoring a relevant journey.

Journeys are only recorded when the driver's phone recognises a transmitting device associated with a vehicle the driver is insured to drive. This avoids irrelevant and potentially misleading data being recorded, as well as reducing energy consumption.

The apparatus and method are applicable to all types of vehicles.

Software, or a software application, as used herein will typically comprise instructions stored in a memory, which when executed by one or more processors, e.g., resident in a mobile electronic device or other device, will cause the processor(s) to perform one or more steps of the methods as described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the disclosed subject matter (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or example language (e.g., "such as") provided herein, is intended merely to better illuminate the disclosed subject matter and does not pose a limitation on the scope of the invention unless otherwise claimed. No language in the specification should be construed as indicating any non-claimed element as essential to the practice of the invention.

Certain embodiments are described herein. Variations of those embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A method for monitoring operation of a vehicle by a driver, in order to monitor driver behaviour, the method comprising:

a) detecting one or more wireless signals with a personal mobile electronic device located in the vehicle;

b) reading an identity of a respective transmitting device for a, or each, wireless signal detected;

c) determining if any read identity is stored in a memory of the electronic device or stored on a remote server in association with information identifying the electronic device or driver by accessing the remote server via a communications network; and d) when a read identity is determined to be stored in the memory of the electronic device and/or the remote server, enabling operation of a positioning device to determine the position of the electronic device and/or activating a motion sensor of the electronic device thereby to detect movement of the electronic device.

2. The method of claim 1 comprising storing data relating to movement of the electronic device in the memory of the electronic device and/or transmitting the data to a remote server, thereby to record details of a journey made by the vehicle when operation of the positioning device has been enabled and the positioning device has determined a position of the electronic device.

3. The method of claim 2 wherein, when the wireless signal of the transmitting device with an identity stored in the memory of the electronic device and/or server is no longer detected recording details of the journey is stopped.

4. The method of claim 1 wherein, following enabling operation of the positioning device and/or motion sensor, the method further comprises:

a) determining, using the positioning device and/or motion sensor, if the electronic device is moving; and b) if the electronic device is moving, storing data relating to movement of the device in the memory of the electronic device and/or transmitting the data to a remote server, thereby to record details of a journey made by the vehicle.

5. The method of claim 4 wherein step b) is performed only if movement of the electronic device at or above a threshold speed is detected.

6. The method of claim 4 wherein, when the wireless signal of the transmitting device with an identity stored in the memory of the electronic device and/or server is no longer detected and no further movement of the electronic device is detected recording details of the journey is stopped.

7. The method of claim 1 wherein the electronic device runs an operating system and the step of detecting wireless signals is performed by the operating system.

8. The method of claim 1 wherein a software application for monitoring operation of a vehicle is provided on the electronic device and the method comprises the electronic device starting the application on detection of a wireless signal, and the software application is arranged to cause the electronic device to determine if the identity of the transmitting device producing the detected signal is stored in the memory of the electronic device and/or on a remote server.

9. The method of claim 8 wherein, if the identity of the transmitting device is not stored in the memory of the electronic device and/or on the remote server, the electronic device closes the software application or places it into a dormant or background state.

10. The method of claim 8 wherein the software application is only started when a pairing event takes place with a transmitting device.

11. The method of claim 1 comprising the initial steps of:

a) placing the electronic device in or near the vehicle to be monitored;

b) enabling a set-up mode on the electronic device;

c) searching for wireless signals using the electronic device;

d) displaying, on a display of the electronic device, the identity of a transmitting device transmitting the/or each detected signal; and e) enabling a user to select a transmitting device known to be on, or otherwise associated with, the vehicle.

12. The method of claim 11 comprising selecting a transmitting device which is installed on the vehicle for purposes other than monitoring driver behaviour.

13. The method of claim 12 wherein the selected transmitting device forms part of an entertainment or communication system.

14. The method of claim 11 comprising storing the identity of the selected transmitting device in the memory of the electronic device and/or transmitting the identity to a remote server together with information identifying the electronic device and/or driver and/or vehicle.

15. The method of claim 1 comprising providing a self-contained wireless transmitting device which transmits a wireless signal conveying an identity of the device and placing the device on the vehicle.

16. A personal mobile electronic device adapted for monitoring operation of a vehicle by a driver, in order to monitor driver behaviour, the device comprising:

a) an electronic signal detector arranged to detect wireless signals and read an identity of a transmitting device transmitted by the signal;

b) a memory;

c) a wireless communication system for communicating with a remote server via a communications network;

d) a positioning device and/or a motion sensor; and e) a processor arranged to determine if an identity of a transmitting device read by the electronic signal detector is stored in the memory of the electronic device and/or stored on the remote server in association with information identifying the electronic device or driver by accessing the server via the communications network; wherein f) the processor is arranged to enable operation of the positioning device to determine the position of the electronic device and/or activate the motion sensor if the identity of a transmitting device read by the electronic signal detector is stored in the memory of the electronic device and/or stored on the remote server in association with information identifying the electronic device or driver, thereby to detect movement of the electronic device.

17. The personal mobile electronic device of claim 16 wherein the processor is arranged to store data relating to movement of the electronic device in the memory and/or to transmit the data to the remote server, thereby to record details of a journey made by the vehicle when operation of the positioning device has been enabled and the positioning device has determined a position of the electronic device.

18. The personal mobile electronic device of claim 17 wherein the processor is arranged so that if the wireless signal of the transmitting device with an identity stored in the memory of the electronic device and/or on the server is no longer detected recording details of the journey is stopped.

19. The personal mobile electronic device of claim 16 wherein the processor is arranged, following enabling operation of the positioning device and/or motion sensor, to:

a) determine, using the positioning device and/or motion sensor, if the electronic device is moving; and b) if the electronic device is moving, to store data relating to movement of the device in the memory and/or transmit the data to a remote server, thereby to record details of a journey made by the vehicle.

20. The personal mobile electronic device of claim 19 wherein the processor is further arranged to perform step b) only if movement of the electronic device at or above a threshold speed is detected.

21. The personal mobile electronic device of claim 19 wherein the processor is arranged so that if the wireless signal of the transmitting device with an identity stored in the memory of the electronic device and/or server is no longer detected and no further movement of the electronic device is detected recording details of the journey is stopped.

22. The personal mobile electronic device of claim 16 wherein the processor runs an operating system and the operating system is arranged to cause the apparatus to detect wireless signals.

23. The personal mobile electronic device of claim 22 wherein a software application for monitoring operation of a vehicle is stored in the memory and the operating system is arranged to start the application when a wireless signal is detected, whereupon the software application causes the processor to determine if the identity of the transmitting device producing the detected signal is stored in the memory of the electronic device and/or on the remote server.

24. The personal mobile electronic device of claim 23 wherein, if the identity of the transmitting device is not stored in the memory of the electronic device and/or on the remote server, the software application is configured to close or enter into a dormant or background state.

25. The personal mobile electronic device of claim 23 wherein the operating system is configured to start the application, if the application is not already running, only when a pairing event takes place with a transmitting device.

26. The personal mobile electronic device of claim 16 comprising:

a) a display; and b) a user input device; and wherein c) the processor is arranged to enable a user to enter a set up mode, and further arranged so that when the set up mode is entered it causes the wireless signal detector to detect wireless signals and to display on the display the identity of a transmitting device transmitting the/or each detected signal, and to enable a user to select, using the input device, a transmitting device known to be on, or otherwise associated with, the vehicle.

27. The personal mobile electronic device of claim 26 wherein the processor is configured to store the identity of a selected transmitting device in the memory and/or to cause the wireless communication system to transmitting the identity to the remote server, together with information identifying the electronic device and/or driver.

28. A non-transitory computer readable medium storing computer software comprising instructions which, when executed by a mobile personal electronic device, perform the method of claim 1.

* * * * *